United States Patent [19]

Godfrey

[11] Patent Number: 4,642,814

[45] Date of Patent: Feb. 17, 1987

[54] ATHLETIC PADDING

[76] Inventor: Jerry W. Godfrey, 6812 Radial Dr., Fayetteville, Cumberland County, N.C. 28301

[21] Appl. No.: 793,777

[22] Filed: Nov. 1, 1985

[51] Int. Cl.[4] ..... A41D 13/00

[52] U.S. Cl. ..... 2/2; 2/24; 2/413

[58] Field of Search ..... 2/2, 24, 411, 413

[56] References Cited

U.S. PATENT DOCUMENTS

| | | | |
|---|---|---|---|
| 363,170 | 5/1887 | Ridgill | 2/24 |
| 1,317,305 | 9/1919 | Miller | 2/24 |
| 1,560,825 | 11/1925 | Kelticka | 2/24 |
| 2,664,567 | 1/1954 | Nichols | 2/413 |
| 4,213,202 | 7/1980 | Larry | 2/2 |
| 4,307,471 | 12/1981 | Lovell | 2/411 |

FOREIGN PATENT DOCUMENTS

| | | | |
|---|---|---|---|
| 0704725 | 5/1931 | France | 2/411 |
| 0005132 | of 1899 | United Kingdom | 2/24 |

*Primary Examiner*—Louis K. Rimrodt
*Attorney, Agent, or Firm*—Mills & Coats

[57] ABSTRACT

This invention is an improved padding used by athletes and others to prevent or greatly reduce the instances of injury due to blows to the body and its appendages, particularly to the more boney parts thereof such as knees, elbow, shoulders, thighs, hips, and the like. This is accomplished through the utilization of non-metallic spring means encapsulated in a vinyl type material with air pockets formed therebetween with cross-stress means for additional protection.

14 Claims, 5 Drawing Figures

ATHLETIC PADDING

FIELD OF INVENTION

This invention relates to protecting means and more particularly to energy absorbing padding used by athletes and others to prevent or reduce the incidents of injuries.

BACKGROUND OF INVENTION

Man has always been concerned with protecting his body from injury caused by outside means. With the advent of contact sports such as gladiator exhibitions in ancient times or the early days of football, leather coverings and pads were used, sometimes even with soft backings. Although these pads helped, injuries were still more the norm than the unusual.

In more recent years hard plastic has been developed with sponge rubber and similar backing used in conjunction therewith to contouringly fit over the areas most frequently subject to injury. Although the incidents of injuries has been drastically reduced, they are still way above acceptable limits.

BRIEF DESCRIPTION OF INVENTION

After much research and study into the above mentioned problems the present invention has been developed to provide a superior padding for the body and appendages of the user therof to greatly reduce the chances of contact sport injuries.

The above is accomplished through the provision of shock absorbing springs and air pockets within the pads. The outer layer of the spring pad is composed of a flexible sheet with an inner flexible sheet spaced with rows of styrene butadine springs. As the springs expand to their normal, relaxed position, they provide space for cushions of air to form. Upon impact, the springs compress to absorb the shock of the blow while the air pockets cushion the blow additionally.

The improved pads of the present invention include four protective means, the outer flexible sheet, the inner flexible sheet, the styrene butadine springs and the air pockets.

In view of the above, it is an object of the present invention to provide an improved pad means particularly adapted for use in conjunction with contact sports.

Another object of the present invention is to provide a blow absorbing means in the form of at least two padded layers having spring like means mounted therebetween.

Another object of the present invention is to provide athletic type padding which utilizes a combination of closed cell foam type material, encapsulated spring means, and air pockets to create a cushion effect.

Another object of the present invention is to provide a pad means including the use of styrene butadine springs as a blow absorbing material.

Another object of the present invention is to provide a plurality of encapsulated styrene butadine springs in an athletic type pad.

Another object of the present invention is to provide an athletic type pad which includes a plurality of different shock absorbing means.

Another object of the present invention is to provide an athletic type pad incorporating at least four distinct shock absorbing means.

Other objects and advantages of the present invention will become apparent and obvious from a study of the following description and the accompanying drawings which are merely illustrative of such invention.

DETAILED DESCRIPTION OF INVENTION

With further reference to the drawings, the improved athletic padding of the present invention, indicated generally at 10, can have various exterior configurations depending on the part of the body the pad is designed to protect.

Figure 1:
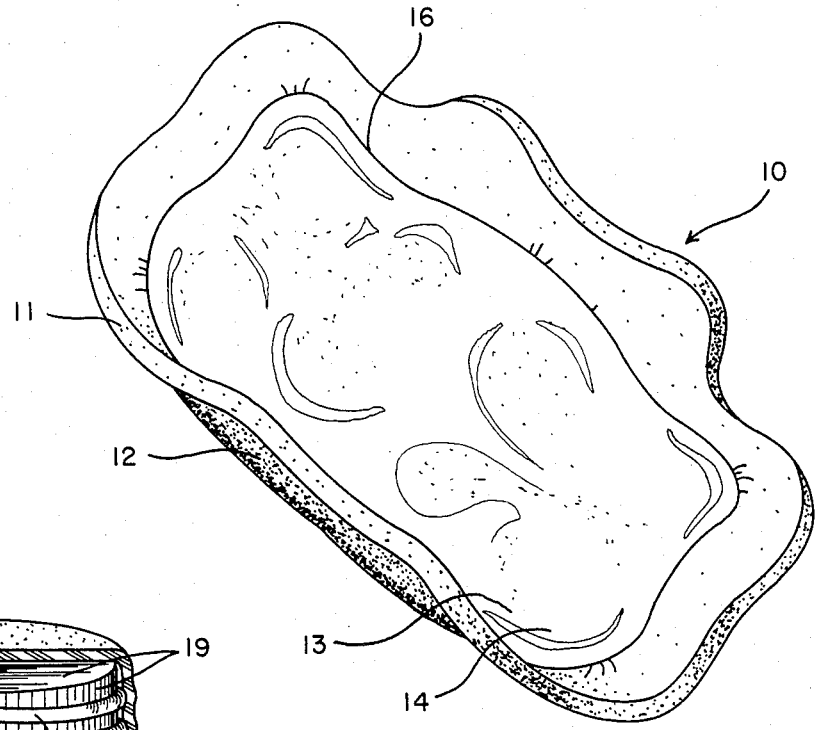
FIG. 1 is a perspective view of a knee type pad incorporating the cushioning means of the present invention.
Figure 3:
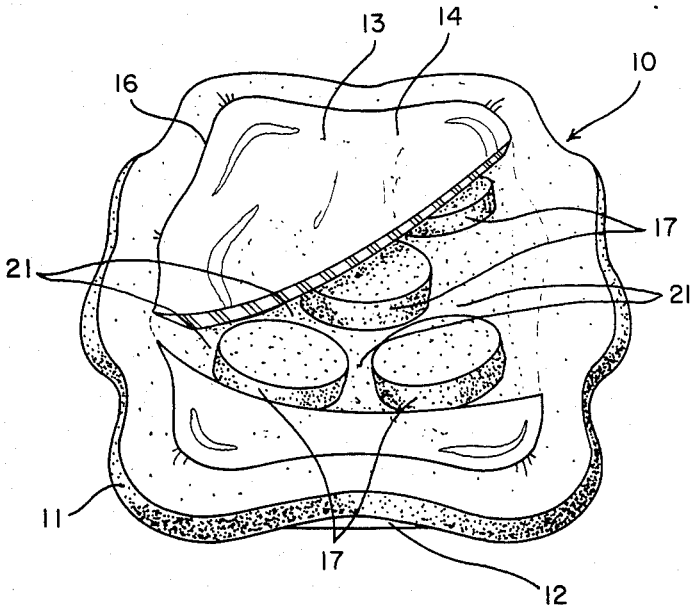
FIG. 3 is a cutaway view of the cushioning means shown in FIG. 1.

Referring specifically to FIGS. 1 and 3 this embodiment is specifically designed as a knee pad, or with slight modifications, can be used as an elbow pad.

The FIG. 1 embodiment includes an outer or exterior pad 11, preferably formed from a closed cell vinyl or foam rubber type material which is preferably coated on the outer surface 12 thereof with a material such as tear resistant vinyl or neoprene. The thickness of the exterior pad 11 is approximately $\frac{3}{8}$ of an inch although it can be either greater or lessor as deemed appropriate.

The interior pad 13 is also formed from a relatively dense, closed cell foam vinyl or rubber with the outer surface or skin 14 (which is adapted to vie juxtaposed to the user 15 thereof) formed from either a tear resistant vinyl or neoprene type material.

The interior pad 13 is fixedly secured about its periphery to the exterior pad 11 as indicated at 16 by any suitable method. Since the joining of pad material of the type described is well known to those skilled in the art, further detailed discussion of this portion of present invention is not deemed necessary.

Figure 2:
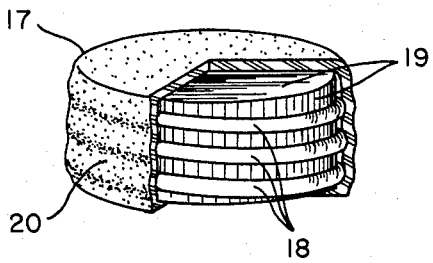
FIG. 2 is an enlarged cut away view of the spring loaded air column portion of the present invention.

A plurality of spring columns 17 are provided between the exterior and interior pads as seen clearly in FIG. 3. Each of the spring column 17 is composed of a coil type spring 18 formed from styrene butadine or similar material with a compressable foam sponge type material forming the core 19 thereof as can clearly be seen in FIG. 2.

Each of the spring columns as described above is encapsulated in a flexible material such as tear resistant vinyl or neoprene. The top and bottom of each of the spring columns are permanently fixed to the interior surfaces of the envelope formed between exterior pad 11 and interior pad 13. Since the encapsulating of foam sponge type material and the fixing of vinyl and/or neoprene type material as herein described is well known to those skilled in the art, further detailed discussion of the same is not deemed necessary.

As can clearly be seen in the cutaway portion of FIG. 3, air spaces 21 are formed between the encapsulated spring columns 17. These air spaces further cushion exterior blows and protect the user 15 therefrom.

Figure 4:
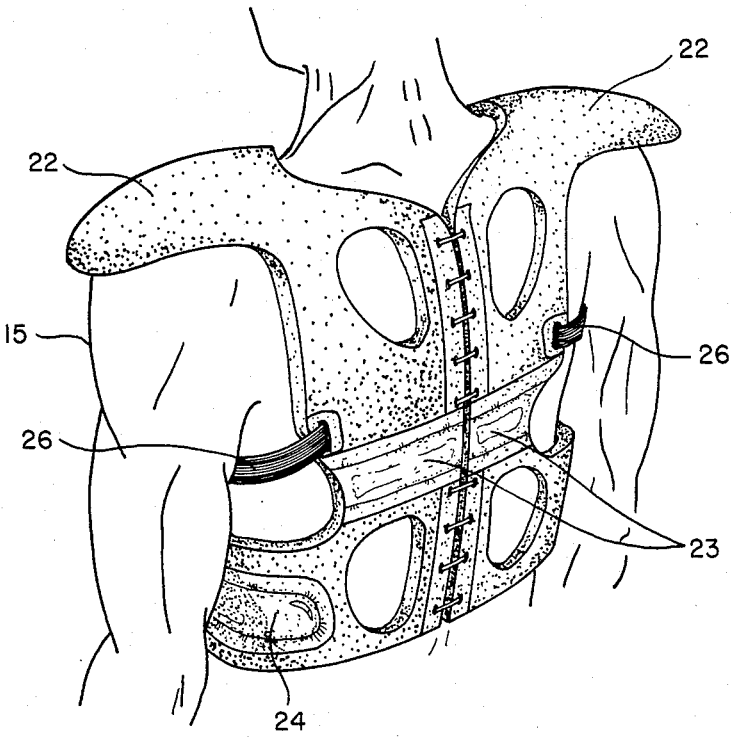
FIG. 4 is a rear perspective view of a combination shoulder and rib pad incorporating the present invention.
Figure 5:
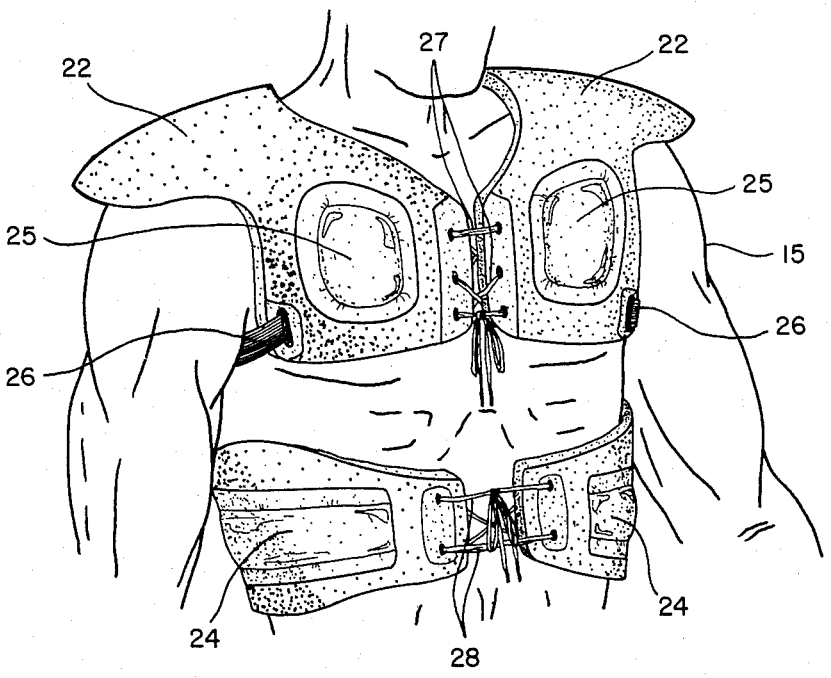
FIG. 5 is a front elevational view of the pads shown in FIG. 4.

FIG. 4 further illustrates use of the improved athletic padding 10 of the present invention by incorporating the same into protective gear worn over the shoulders and upper torso of the user 15 thereof. These additional pads include shoulder pads 22, back pads 23 and rib pads 24. FIG. 5 additionally discloses chest pads 25. Strap means 26 of the type usually associated with football type shoulder pads are provided and extend from the back pads 23 to the chest pads 25 and are of course adjustable. Also, lace type securing means are provided at the juncture of the chest pads 25 as well as at the front of the rib pads as can clearly be seen in FIG. 5. Since strap means of the type indicated at 26 and lace means at the type indicated at 27 and 28 are well known to those skilled in the art, further detailed discussion of the same is not deemed necessary.

A hot dip tear resistant vinyl or neoprene coating can be applied to the pads of the present invention in a manner similar to vinyl coated water skiing vests. Since coatings of this type are well known to those skilled in the art, further detailed discussion thereof is not deemed necessary.

The improved athletic padding in the present invention can either be secured directly over the portion of the body of the user thereof as disclosed in FIGS. 4 and 5 or can be placed in clothing pockets provided for the purposes such as are knee pads and hip pads in a football pants. It is not the means of mounting the pads juxtaposed to the area to be protected but the superb cushioning capability of the pads that make them so superior.

When the improved athletic padding of the present invention has been put on by the user thereof as described above, such user can engage in whatever athletic or similar activity he has chosen. When an exterior blow is struck against the outer surface or skin 12 of exterior pad 11, the closed cell material from which the pad is formed will compact absorbing some of the forces of the blow.

As the exterior pad 11 begins to give, the encapsulated spring columns 17 adjacent the blow area will begin to absorb energy from such blow as the coil spring 18 and the foam sponge core 19 are compressed.

Since the exterior pad 11 and the interior pad 13 form an air tight envelope, the air spaces 21 between the spring column 17 begin to add resistance to the blow due to the compressing of the air in such spaces.

Finally, the relatively thick interior pad 13 formed from closed cell foam type material and located juxtaposed to the user 15 thereof is compressable absorbing additional forces from the blow.

From the above blow absorbing sequence of the exterior pad compressing, the spring column with associated springs and corer compressing, the air passages building resistance through the increasing air pressure, and the interior pad compressing, a superior means for absorbing the energy from an exterior blow is provided.

From the above it can be seen that the present invention provides a multiple staged energy absorbing means which provides superior protection for the athlete or other person wearing the same.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A protective pad means having the capability to absorb the force of a blow comprising: an outer layer and an inner layer of material forming an envelope; a plurality of spring columns mounted interiorly to said envelope; and air passages internal to said envelope and surrounding said spring columns whereby, when said pad means is impacted, said outer and inner layers of the envelope restrict air flow from said air passages so as to form an air cushion that operates in conjunction with said inner and outer layers and said spring columns to absorb the force of the blow.

2. The protective pad means of claim 1 wherein said outer layer is formed from an impact absorbing material.

3. The protective pad means of claim 2 wherein said impact absorbing material is of the closed cell vinyl type.

4. The protective pad means of claim 2 wherein said impact absorbing material is of the closed cell foam rubber type.

5. The protective pad means of claim 1 wherein the inner layer is formed from an impact absorbing material.

6. The protective pad means of claim 5 wherein said impact absorbing material is of the closed cell vinyl type.

7. The protective pad means of claim 5 wherein said impact absorbing material is of the closed cell foam rubber type.

8. The protective pad means of claim 1 wherein said spring columns include a coil spring and a compressible foam-type core disposed within said coil spring to enhance the cushioning effect of said spring coils.

9. The protective pad means of claim 8 wherein said coil spring and said compressible foam-type core associated with that spring are encapsulated in a sheath to maintain said compressible core's position within said coil spring and to further enhance the cushion effect of said air passages.

10. The protective pad means of claim 9 wherein said coil spring and said compressible foam-type core are encapsulated in a sheath constructed of a vinyl-type material.

11. The protective pad means of claim 8 wherein said coil spring is formed from a non-ferrous material.

12. The protective pad means of claim 11 wherein said non-ferrous material is styrene butadine.

13. The protective pad means of claim 8 wherein said coil spring is formed from a non-ferrous material.

14. The protective pad means of claim 13 wherein said non-ferrous material is styrene butadine.

* * * * *